US007490813B1

(12) United States Patent
Weddle

(10) Patent No.: US 7,490,813 B1
(45) Date of Patent: Feb. 17, 2009

(54) RESCUE TOOL

(76) Inventor: David R. Weddle, 1419 Sam Mason Rd., Bunker Hill, WV (US) 25413

( * ) Notice: Subject to any disclaimer, the term of this patent is extended or adjusted under 35 U.S.C. 154(b) by 0 days.

(21) Appl. No.: 12/071,188

(22) Filed: Feb. 19, 2008

(51) Int. Cl.
*B66F 3/24* (2006.01)

(52) U.S. Cl. ..... 254/93 R; 254/134; 248/354.1

(58) Field of Classification Search ..... 254/93 R, 254/133 R, 134, 89 H, 93 H; 248/354.1, 248/200.1, 354.7
See application file for complete search history.

(56) References Cited

U.S. PATENT DOCUMENTS 3,891,187 A 6/1975 Bearden, Jr.
4,660,806 A * 4/1987 Masters ..... 254/11
4,762,304 A * 8/1988 Hill ..... 254/93 R
4,783,053 A * 11/1988 Yirmiyahu et al. ..... 254/93 R
4,909,062 A 3/1990 Yirmiyahu et al.
5,406,826 A * 4/1995 Kuhlmann et al. ..... 72/392
5,732,932 A 3/1998 Michalo
5,769,394 A 6/1998 Yirmiyahu et al.
5,810,333 A * 9/1998 Hickerson et al. ..... 254/93 R
5,987,723 A * 11/1999 McNally et al. ..... 29/254
6,027,102 A * 2/2000 Krupa ..... 254/93 R
6,394,405 B1 * 5/2002 Roxton et al. ..... 248/354.1
6,736,371 B1 * 5/2004 Burrows ..... 254/133 A
6,746,183 B1 * 6/2004 Sullivan ..... 405/272
6,916,013 B2 * 7/2005 Cardona ..... 254/93 R
7,434,785 B1 * 10/2008 McMorrow ..... 254/291
7,451,960 B2 * 11/2008 Kirchner et al. ..... 254/1

* cited by examiner

*Primary Examiner*—Lee D Wilson
(74) *Attorney, Agent, or Firm*—Stephen R. Greiner

(57) ABSTRACT

A rescue tool including a hydraulic jack having an extensible ram and a pivoting handle for pumping the jack so as to extend the ram. The handle has a free end and a socket in the free end. A load-distributing head plate is affixed to the ram. A telescoping arm is affixed to the jack. A load-distributing foot plate is affixed to the arm remote from the jack. A rod is affixed to the foot plate for selective insertion into the socket so as to connect the free end of the handle to the foot plate.

10 Claims, 3 Drawing Sheets

FIG. 1
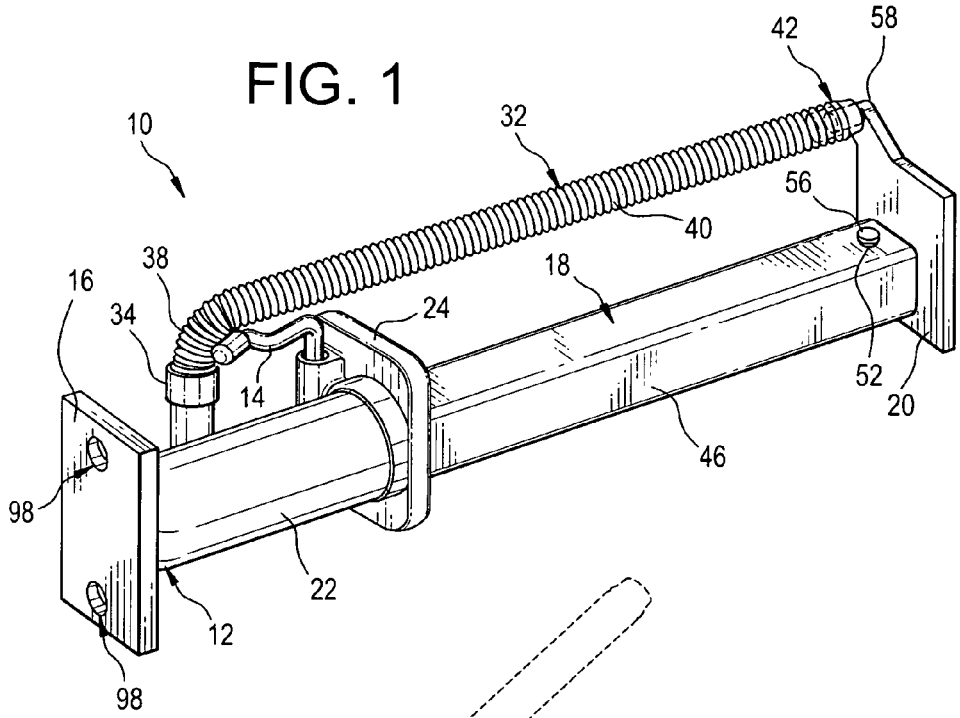
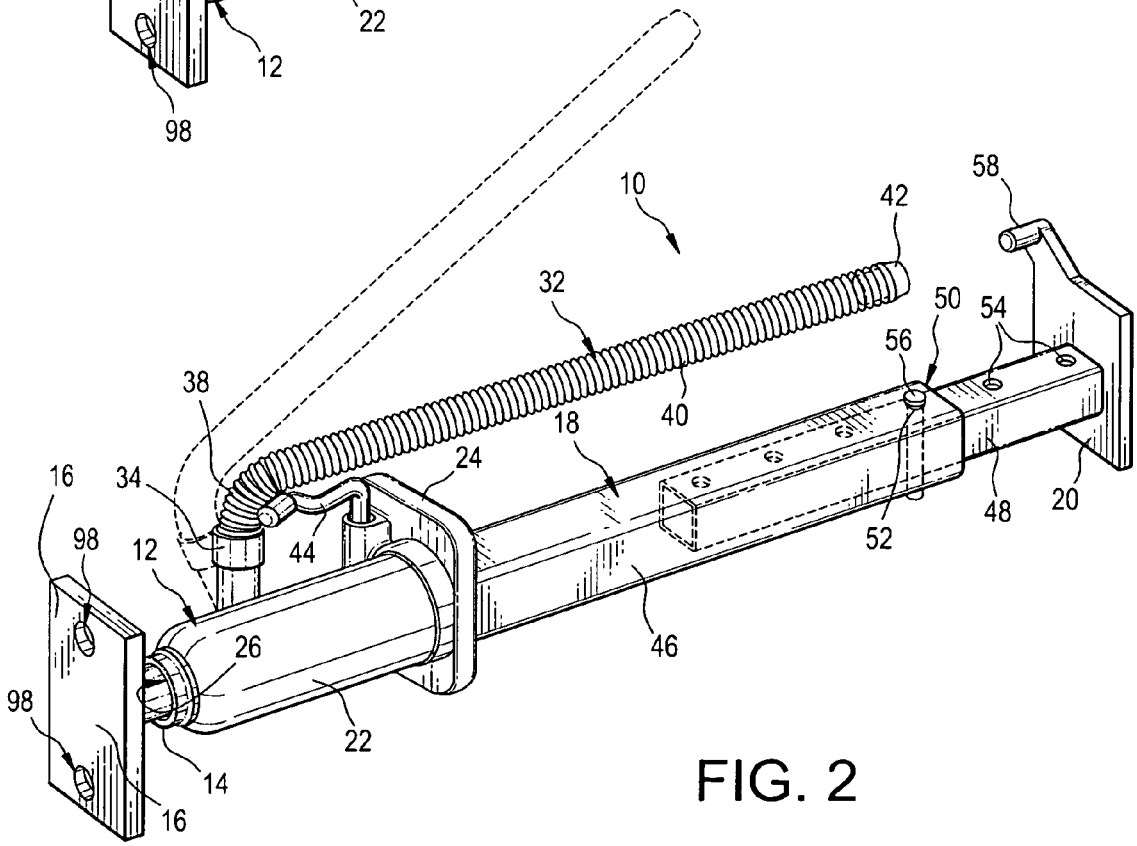
FIG. 2

FIG. 3
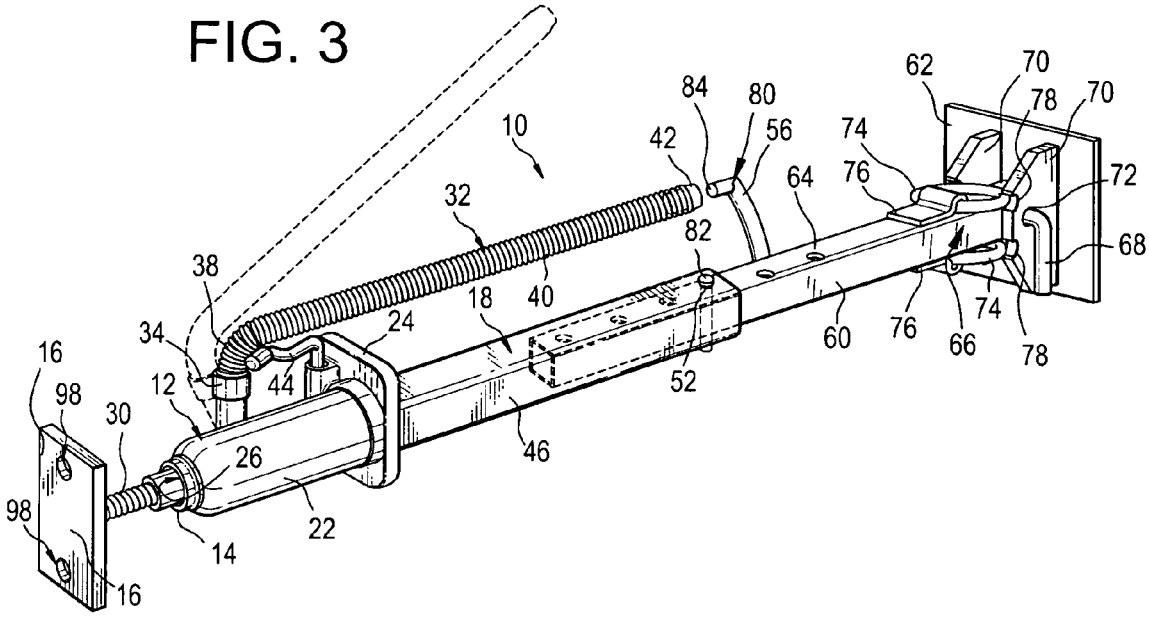
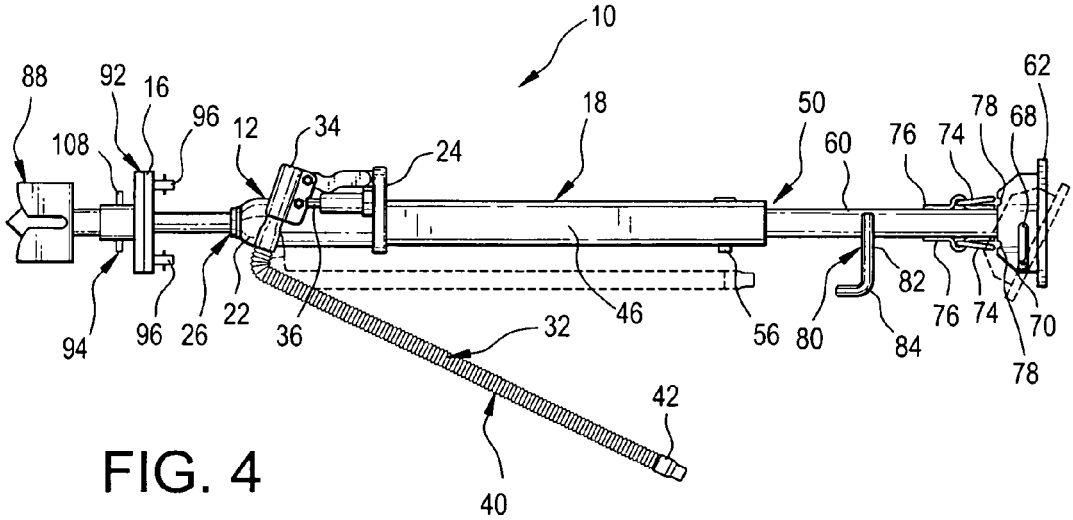
FIG. 4

RESCUE TOOL

FIELD OF THE INVENTION

The present invention relates generally to implements or apparatus for applying pushing or pulling force utilizing fluid pressure.

BACKGROUND OF THE INVENTION

Firefighters often need to rapidly enter a dwelling in emergency situations. Often, entry is gained by breaking down a locked door with a battering ram. A conventional battering ram includes an elongated weight having a pair of handles that extend outwardly from the weight. After grasping the handles, one or two firefighters swing the weight into a door with a force sufficient to cause the door to fail. Depending on the strength of the door and its frame, several swings of the ram can be required to break down the door. The door is usually destroyed as a result.

After a victim is transported, or a fire is put out, it is necessary to secure a dwelling to prevent further losses. If its door has been destroyed by battering, it is difficult for firefighters, without taking extraordinary measures, to prevent unauthorized people from entering the dwelling once they have gone away. In high crime areas, leaving a dwelling unlocked and unattended is an invitation for mischief.

SUMMARY OF THE INVENTION

In light of the problems associated with the apparatus and methods employed by firefighters in battering their way into dwellings, it is a principal object of the invention to provide a rescue tool that permits firefighters to quickly and safely open a locked door of a building in an emergency situation without damaging either the door or the building. A door that is opened with the rescue tool can be closed and relocked when the firefighters determine that it is safe to do so. Thus, trespassers cannot enter the building through an open door when the firefighters are gone.

It is another object of the invention to provide a rescue tool of the type described that can be easily transported and stored in a compact configuration. In extraordinary situations, the rescue tool can be employed as a battering ram while it is maintained in a compact configuration.

Still another object of the invention is to provide a rescue tool that can be used for purposes other than opening doors such as: hanging smoke ejectors in a position where they can evacuate smoke from buildings, stabilizing vehicles that have rolled onto their sides or tops, moving dashboards to free trapped vehicle occupants, propping up buildings that are in danger of falling down, and supporting the walls of collapsed trenches.

It is a further object of the invention to provide a rescue tool that is easy to use in chaotic situations and can be deployed by one person with minimal instruction and without resort to any additional tools. The rescue tool is intuitive to use.

It is an object of the invention to provide improved features and arrangements thereof in a rescue tool for the purposes described which is portable, lightweight in construction, inexpensive to manufacture, and dependable in use.

Briefly, the rescue tool in accordance with this invention achieves the intended objects by featuring a hydraulic jack having an extensible ram and a pivoting handle for pumping the jack to extend the ram. The handle has a free end and a socket in the free end. An extension screw is threaded into the ram. A load-distributing head plate is affixed to the extension screw. A telescoping arm is affixed to the hydraulic jack. A load-distributing foot plate is affixed to the arm remote from the jack. A retaining rod is affixed to the foot plate for selective insertion into the socket so as to connect the free end of the handle to the foot plate.

The foregoing and other objects, features, and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which:

FIG. 1 is a perspective view of a rescue tool in accordance with the present invention shown in a retracted condition.

FIG. 2 is a perspective view of the rescue tool of FIG. 1 in an extended condition.

FIG. 3 is a perspective view of the rescue tool in deployment with an alternate leg having a pivoting base plate.

FIG. 4 is a side view of the rescue tool of FIG. 3.

Similar reference characters denote corresponding features consistently throughout the accompanying drawings.

DETAILED DESCRIPTION OF THE PREFERRED EMBODIMENT

Figure 5:
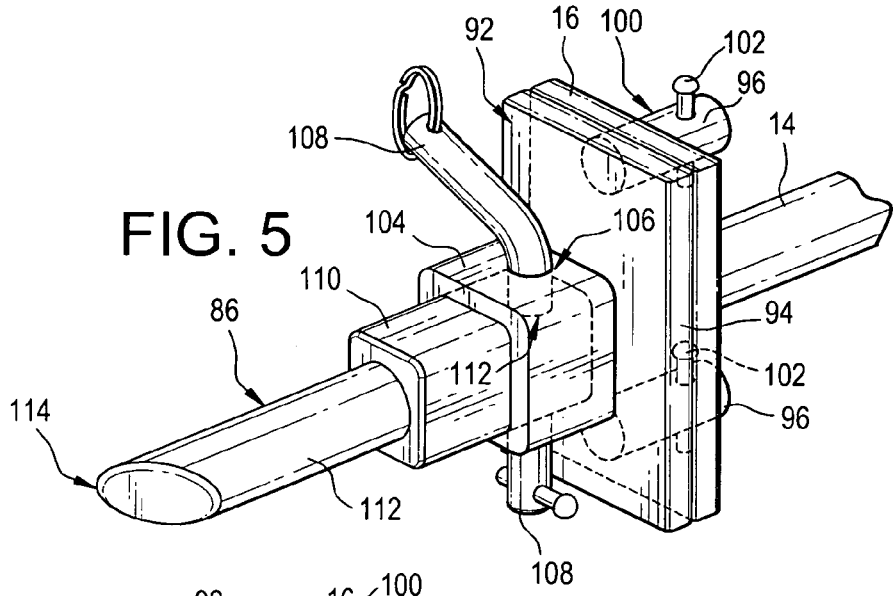
FIG. 5 is an enlarged perspective view of the detachable, spiked head of the rescue tool.
Figure 6:
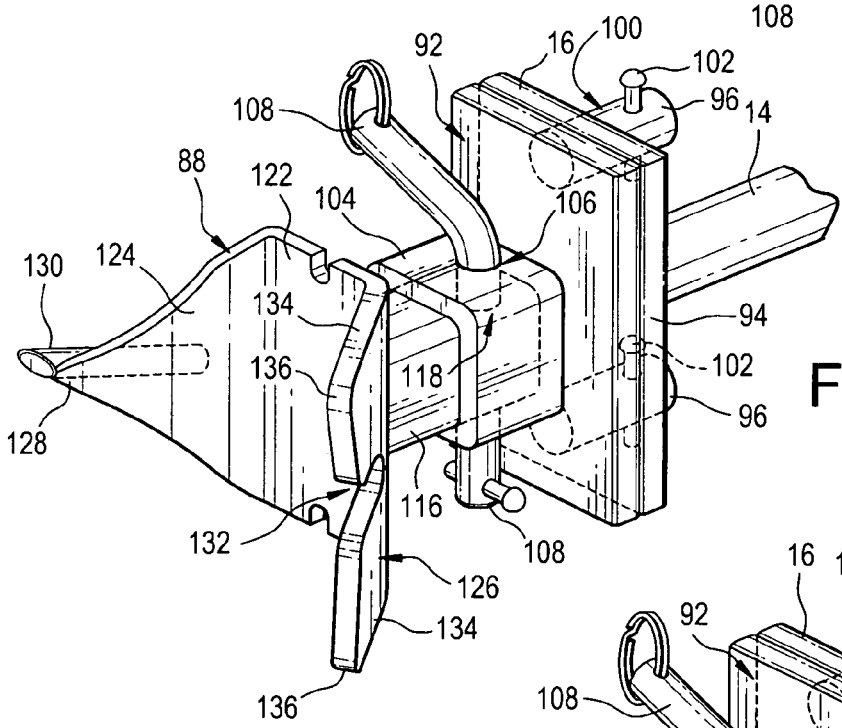
FIG. 6 is an enlarged perspective view of the detachable, forked head of the rescue tool.
Figure 7:
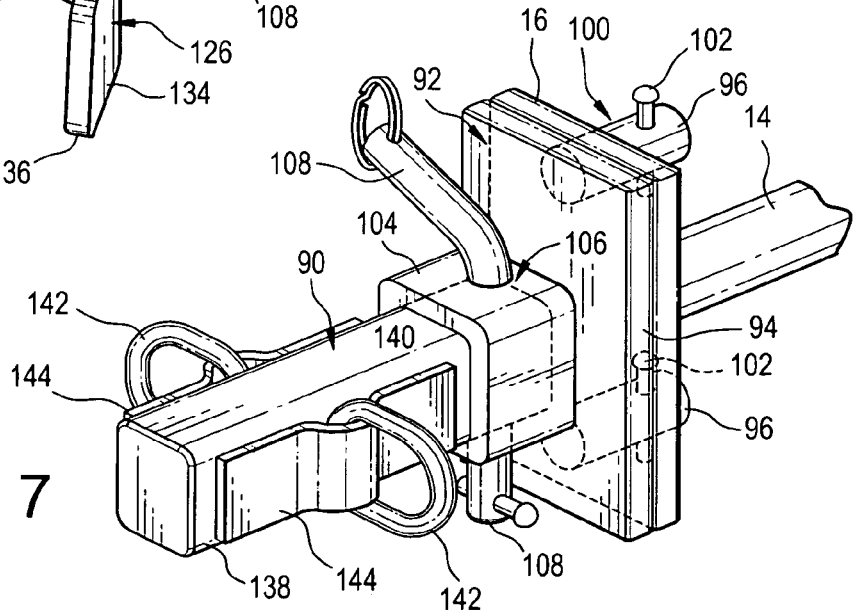
FIG. 7 is an enlarged perspective view of the detachable, ringed head of the rescue tool.

Referring now to the FIGS., a rescue tool in accordance with the present invention is shown at 10. Tool 10 includes a manually operated, hydraulic jack 12 having an extensible ram 14 to the free end of which a load-distributing head plate 16 is affixed. A telescoping arm 18, capable of being manually adjusted in terms of length, is affixed to jack 12. A load-distributing foot plate 20 is affixed to the end of arm 18 that is remote from jack 12.

Jack 12 is a "bottle jack," model no. 76503, available from Norco Industries of Compton, Calif. In order to move large loads, jack 12 has a 3-ton capacity with a 50% safety overload factor. Jack 12 includes a pressure cylinder 22 affixed to the front side of a shoulder plate 24. Cylinder 22 has an opening 26 at its free end from which ram 14 is selectively extended to impart a pushing force. Ram 14 is provided with an internally threaded, longitudinal bore 28 into which is turned an extension screw 30. Head plate 16, for contacting a door frame, is affixed to the free end of screw 30 and is oriented at right angles to screw 30. Screw 30 is rotated to effectively increase the length of ram 14 if there is not enough hydraulic stroke to displace a door frame by the desired amount.

A handle 32 is pivotally connected by means of a handle receiver 34 to both shoulder plate 24 and a piston 36. Handle 32 is L-shaped and has a short segment 38 and a long segment 40 that are joined together at right angles. As shown, segment 38 fits into receiver 34 and projects outwardly from cylinder 22 when handle 32 is in its storage position. Segment 40, however, is oriented parallel to the longitudinal axis of cylinder 22 and extends past shoulder plate 24 when handle 32 is in its storage position. The free end of segment 40 is provided with a socket 42.

Piston 36 is reciprocated by moving handle 32 in an up and down motion. With every stroke of handle 32 and piston 36, hydraulic fluid enters cylinder 22 and causes ram 14 to move outwardly from opening 26 and drive head plate 16 against a door frame. Up to three tons of force can be applied by head plate 16 before damage to jack 12 can be anticipated.

The actuating lever 44 of a hydraulic fluid release valve extends from shoulder plate 24 adjacent handle receiver 34. Rotating lever 44 in the clockwise direction causes hydraulic fluid driven by piston 36 into cylinder 22 to remain within cylinder 22 and prepares jack 12 for applying a pushing force. Rotating lever 44 in a counterclockwise direction, however, causes hydraulic fluid to drain from cylinder 22 into an internal storage reservoir (not shown) and retracts ram 14 when it is placed under a load.

Telescoping arm 18 extends from shoulder plate 24 in opposition to cylinder 22. Arm 18 includes a tubular sleeve 46 that is affixed to the rearward side of shoulder plate 24 and is axially aligned with cylinder 22. A movable limb 48 is slidably fitted within sleeve 46 and can be withdrawn from the open, rear end 50 of sleeve 46. Although limb 48 is shown to have a length that is substantially equal to that of sleeve 46, this is a matter of design choice as limb 48 can be provided with any practical length.

Sleeve 46 and limb 48 are respectively provided with transverse apertures 52 and 54 that can be selectively axially aligned to receive a locking pin 56 that sets the length of arm 18. The rearward end of sleeve 46 has aperture 52 whereas limb 48 has a number of spaced-apart apertures 54 that can be individually slid into alignment with aperture 52 by moving limb 48. With a light pull by a firefighter, limb 48 is partially extracted from sleeve 46 so as to align a selected pair of apertures 52 and 54 and, after inserting pin 56 into the aligned apertures 52 and 54, the length of arm 18 is fixed to accommodate a door frames of virtually any width.

Foot plate 20 is affixed to the rearward end of limb 48. Like head plate 16, foot plate 20 is provided with dimensions sufficient to distribute anticipated loads to a door frame without crushing the door frame. A retaining rod 58 is affixed to the forward surface of foot plate 20 and projects forwardly toward jack 12 parallel to limb 48. Rod 58 is adapted to be snugly inserted into socket 42 when handle 32 is in its storage position and limb 48 is fully inserted into sleeve 46. (To keep limb 48 fully inserted within sleeve 46, pin 56 is extended through the rearwardmost aperture 54 and aperture 52.) With rod 58 being inserted into socket 42, handle 32 is supported from both ends creating a strong C-shaped arrangement that permits tool 10 to be carried from place to place or swung as a battering ram 14 in extreme circumstances.

An alternative limb 60 to which a foot plate 62 is pivotally attached is provided for use in tool 10. Limb 60 is a tubular member of a suitable length that is slidably fitted within sleeve 46 and is withdrawn from the open, rear end 50 of sleeve 46. Like limb 48, limb 60 has a number of spaced-apart, transverse apertures 64 for the selective axial alignment with aperture 52 and the receipt of locking pin 56 that sets the length of arm 18. The rearward end of limb 60, however, has an additional transverse aperture 66 oriented at 90° to apertures 64 for the receipt of a pivot pin 68.

Foot plate 62 is affixed by means of pivot pin 68 to limb 60. To this end, a pair of retaining flanges 70 are affixed in a spaced-apart relationship to the forward surface of foot plate 62. As shown, each of flanges 70 is provided with an central aperture 72 through which pivot pin 68 is extended to attach foot plate 62 to limb 60.

A pair of retaining rings 74 is attached to limb 60 to selectively lock foot plate 62 at right angles to limb 60. Rings 74 are pivotally attached by rigid straps 76 to opposite sides of limb 60 forwardly of flanges 70. When swung rearwardly, rings 74 loosely engage shallow troughs 78 in the forward edges of flanges 70 to prevent foot plate 62 from pivoting. When swung forwardly, however, rings 74 disengage from troughs 78 thereby permitting foot plate 62 to swing freely and seat readily against load-bearing surfaces that are uneven or sloping.

Forwardly of rings 74, a retaining rod 80 is affixed to limb 60. Rod 80 is L-shaped and has a transverse segment 82 and a longitudinal segment 84 that are joined together at right angles. Segment 82 is affixed to one side of limb 60 and projects outwardly from limb 60. Segment 84, however, is oriented parallel to the longitudinal axis of limb 60 and projects toward jack 12. Segment 84 is adapted to be snugly inserted into socket 42 when handle 32 is in its storage position and limb 60 is fully inserted into sleeve 46. With segment 84 being inserted into socket 42, handle 32 is supported from both of its ends.

An assortment of auxiliary heads, shown at 86, 88, and 90, can be utilized with tool 10 for puncturing, prying, and pulling. To attach heads 86, 88, and 90, an adapter 92 is first connected to head plate 16. Adapter 92 has a mounting plate 94 to the rearward side of which a pair of spaced-apart alignment pins 96 are affixed for insertion into correspondingly positioned alignment apertures 98 provided in head plate 16. The free ends of pins 96 that extend through apertures 98 are provided with transverse apertures 100 for the attachment of retaining pins 102 or similar retainers that prevent pins 96 from being easily withdrawn from apertures 98 and plates 16 and 94 from being detached. Also, adapter 92 has a tubular socket member 104 that is affixed to the forward surface of mounting plate 94. Socket member 104 provides a socket into which can be inserted heads 86, 88, and 90. A transverse aperture 106 passes through socket member 104 for the receipt of a retaining pin 108.

Spiked head 86 is adapted for releasable attachment to adapter 92. Head 86 includes a base 110 that can be snugly inserted into socket member 104. Base 110 is provided with a transverse aperture 112 through which pin 108 is extended to attach head 86 to adapter 92 and, consequently, to tool 10. Affixed to the forward end of base 110 and extending forwardly therefrom is a spike 112 with a sharpened tip 114.

Forked head 88 is adapted for releasable attachment to adapter 92 as a substitute for heads 86 and 90. Head 88 has a base 116 that can be snugly inserted into socket member 104. Base 116 is provided with a transverse aperture 118 through which pin 108 is extended to attach head 88 to adapter 92. Affixed to the forward end of base 116 is a fork 120. As shown, fork 120 has an intermediate portion 122 to the opposite sides of which a pair of tines 124 and 126 extend forwardly at 45° angles so as to be oriented at right angles to one another. Tine 124 tapers to a sharpened point 128 at its center which is reinforced by a hardened skewer 130 that is affixed to the rearward surface of tine 124. Tine 126, on the other hand, is bifurcated by a medial slot 132 that separates a pair of fingers 134, each of which is respectively tapering to a sharpened point 136 at its outer edge.

Ringed head 90 can be releasably attached to adapter 92 when needed. Head 90 has a base 138 that can be snugly inserted into socket member 104. Base 138 is provided with a transverse aperture 140 through which pin 108 is extended to attach head 90 to adapter 92. Pivotally attached to the forward end of base 138 is a pair of lifting rings 142. Rings 142 are pivotally attached by rigid straps 144 to opposite sides of base 138 forwardly of aperture 140.

The use of rescue tool 10 to open a locked door with minimal damage to the door and its frame is straightforward. First, tool 10 is oriented horizontally in a door frame slightly above the door lock such that head plate 16 engages one side of the door frame and foot plate 20 engages the opposite side of the door frame. If tool 10 is loose, extension screw 30 is rotated until a snug fit is obtained and tool 10 remains in the desired location. Next, the positioning of the hydraulic fluid release valve lever 44 is checked to ensure that it is in its "closed" position whereby pumped fluid remains in cylinder 22. Now, pumping handle 32 in an up and down motion extends ram 14.

Continued pumping causes plates 16 and 20 to widen the door frame. At this time, it is a good idea to inspect the position of tool 10 in relation to the door frame to ensure that unstable conditions are not developing. If plates 16 and 20 look like they are slipping, it is a good idea to release pressure by moving lever 44 appropriately and repositioning tool 10 when the pressure is fully released. If all looks well, pumping continues to the point where the lock strike no longer engages the door thereby permitting the door to be swung open in the usual manner.

Passage through a door cannot be easily be made until tool 10 is removed from the door frame. Removal is quickly accomplished by rotating lever 44 in a counterclockwise direction to its "open" position to discharge hydraulic fluid from cylinder 22 and permit ram 14 to retract back into cylinder 22. The retraction of ram 14, of course, disengages plates 16 and 20 from the door frame and which point tool 10 can be set aside for later use.

The process of opening a locked door requires only a few moments to complete and can be accomplished by the efforts of only one firefighter. In the end, little or no damage to the door or door frame result from the use of tool 10. Thus, when the firefighters have completed their work at a dwelling that was entered using tool 10, the dwelling can be relocked to prevent unauthorized entry.

Rescue tool 10 can be used in a variety of ways, many of which are harmless to things brought into contact with tool 10. One harmless use involves the employment of tool 10 as a smoke ejector hanger where tool 10 is clamped across the top of a doorway or window opening and a powerful air blower is suspended from tool 10 to propel smoke or noxious fumes from a structure. Another harmless use involves the vertical or horizontal positioning of tool 10 to support an unstable roof, building wall, trench or porch so that firefighters can more safely access the surrounding area. Limbs 48 and 60 having a length of 3-10 feet facilitate the positioning of tool 10 between the walls of a dwelling or excavation.

Tool 10, having head 90 and limb 60 employed therewith, can be used in a non-destructive manner in the stabilization of vehicles that have overturned. To accomplish this, the transmission of the overturned vehicle is first placed in "park" and the parking brake is engaged. Then, foot plate 62 is pivoted so that it firmly engages the ground in a location adjacent the lifting point of the vehicle and jack 12 is positioned above plate 62. Next, one or more ratchet straps (not shown) are extended between rings 74 and an anchor point on the vehicle diagonally opposite the part being lifted to ensure that foot plate 62 cannot slip. Now, another ratchet strap (not shown) is extended from rings 142 to the lifting point, like an axle, on the vehicle and made taught by rotating extension screw 30 or otherwise. Then, by pumping handle 32, ram 14 is extended to draw the lifting point upwardly by a ratchet strap. Once the vehicle is elevated to the desired height, jack stands can be placed around the vehicle to bear shifting loads. Now, lever 44 is moved to retract ram 14 and lower the vehicle onto the stands. After the work is done and the occupants of the vehicle, if any, are extracted, lever 44 is moved back to retain hydraulic fluid within cylinder 22 and jack 12 is pumped so that the jack stands can be removed. Finally, lever 44 is moved to release hydraulic fluid from cylinder 22 so as to retract ram 14 and lower the vehicle to the ground.

Rescue tool 10 can be used in a manner whereby it partially penetrates the things that it contacts. For example, it may not be practical to connect non-damaging ratchet straps to rings 74 and 142 to stabilize an overturned vehicle. In such instances, it may be easier for tool 10 to gain a grip upon the vehicle by driving the spike 112 of head 86 or the tine 124 of head 88 into a vehicle door or other sheet metal component. With pivoting foot 62 firmly planted on the ground, ram 14 is extended in the usual manner by pumping handle 32 to move the vehicle in the desired direction. For enhanced safety, jack stands or other props can be used to back-up tool 10 once the vehicle is moved.

Sometimes vehicle crashes result in the displacement of dashboards and the entrapment of vehicle occupants. Rescuers can free entrapped occupants with tool 10 employing forked head 88. First, foot plate 20 of tool 10 is positioned against the bottom of the "B" post of the vehicle and head 88 is pressed against the lower edge of the vehicle's dashboard. Next, a relief cut is made through the floorboard at the bottom of the "A" post of the vehicle with a saw. Now, handle 32 is pumped to drive ram 14 outwardly so as to move the dashboard a sufficient distance upward to free a trapped occupant.

It is always important that a door be quickly and reliably opened in an emergency. A loss of time can result in the treatable injury of a victim becoming life threatening or a manageable fire getting out of control. In extreme situations there pumping handle 32 is impractical or impossible, tool 10 can be used as a battering ram when it is in its compact state with handle 32 engaged with rod 58. Either end of tool 10 can be used for battering, however, it is suggested that foot plate 20 be used as a first choice since it minimizes the likelihood that jack 12 will be damaged. Swinging tool 10 in chaotic surroundings (often wet, smoke-filled, and dark) can result in harm to firefighters, so it is only recommended as an option of last resort.

While rescue tool 10 has been described with a high degree of particularity, it will be appreciated by those skilled in the art that modifications can be made to it. Therefore, it is to be understood that the present invention is not limited solely to tool 10, but encompasses any and all tools within the scope of the following claims.

I claim:

1. A rescue tool, comprising:

a hydraulic jack having an extensible ram and a pivoting handle for pumping said jack so as to extend said ram, and said handle having a free end and a socket in said free end;

a load-distributing head plate being affixed to said ram;

a telescoping arm being affixed to said hydraulic jack;

a load-distributing foot plate being affixed to said arm remote from said jack; and, a retaining rod being affixed to said foot plate for selective insertion into said socket so as to connect said free end of said handle to said foot plate.

2. The rescue tool according to claim 1 wherein said ram has an internally threaded, longitudinal bore and said rescue tool further comprises an extension screw being turned into said longitudinal bore for affixing said head plate to said ram.

3. The rescue tool according to claim 1 wherein said telescoping arm includes:

a tubular sleeve being affixed to said jack and being axially aligned with said ram, and said sleeve being provided with a first transverse aperture;

a movable limb being slidably fitted within said sleeve, and said limb being provided with a plurality of spaced-apart, second transverse apertures adapted for selective axial alignment with said first transverse aperture; and, a locking pin being received within said first transverse aperture and one of said second transverse apertures so as to fix the length of said arm.

4. The rescue tool according to claim 3 wherein said foot plate is pivotally attached to said movable limb.

5. The rescue tool according to claim 4 wherein said rescue tool further comprises a pair of retaining rings being pivotally attached to said limb adjacent said foot plate that, in a first position, engage said foot plate and prevent said foot plate from pivoting and, in a second position, disengage said foot plate and permit said foot plate to pivot.

6. The rescue tool according to claim 1 wherein said head plate is provided with a pair of spaced-apart alignment apertures and said rescue tool further comprises an adapter for the attachment of functional heads, said adapter including:

a mounting plate having opposed sides and being adapted for flush positioning against said head plate;

a pair of spaced-apart alignment pins being affixed to one of said opposed sides of said mounting plate for positioning within said alignment apertures in said head plate; and, a tubular socket member being affixed to the other of said opposed sides of said mounting plate.

7. The rescue tool according to claim 6 further comprising a functional head having a spike.

8. The rescue tool according to claim 6 further comprising a functional head having a fork.

9. The rescue tool according to claim 6 further comprising a functional head having a pair of lifting rings.

10. A rescue tool, comprising:

a hydraulic jack having an extensible ram and a pivoting handle for pumping said jack so as to extend said ram, and said handle having a free end and a socket in said free end;

an extension screw being threaded into said ram;

a load-distributing head plate being affixed to said extension screw;

a telescoping arm being affixed to said hydraulic jack;

a load-distributing foot plate being affixed to said arm remote from said jack; and, a retaining rod being affixed to said foot plate for selective insertion into said socket so as to connect said free end of said handle to said foot plate.

* * * * *